US008587393B2

(12) United States Patent
Azzola et al.

(10) Patent No.: US 8,587,393 B2
(45) Date of Patent: Nov. 19, 2013

(54) PROTECTION DEVICE FOR AN AUTOMATIC CIRCUIT BREAKER AND AUTOMATIC CIRCUIT BREAKER COMPRISING THIS DEVICE

(75) Inventors: Lucio Azzola, Bergamo (IT); Federico Gamba, Bergamo (IT)

(73) Assignee: ABB S.p.A., Milan (IT)

( * ) Notice: Subject to any disclaimer, the term of this patent is extended or adjusted under 35 U.S.C. 154(b) by 667 days.

(21) Appl. No.: 12/516,602

(22) PCT Filed: Nov. 8, 2007

(86) PCT No.: PCT/EP2007/062070

§ 371 (c)(1),
(2), (4) Date: May 28, 2009

(87) PCT Pub. No.: WO2008/074570

PCT Pub. Date: Jun. 26, 2008

(65) Prior Publication Data

US 2010/0073114 A1 Mar. 25, 2010

(30) Foreign Application Priority Data

Dec. 21, 2006 (IT) ..... BG2006A0065

(51) Int. Cl.
*H01H 9/00* (2006.01)

(52) U.S. Cl.
USPC ..... 335/174; 335/18; 335/21; 335/38; 335/170; 335/172

(58) Field of Classification Search
USPC ..... 335/6–10, 18, 21, 23–25, 35–42, 335/141–146, 155, 164–176, 185–189, 203
See application file for complete search history.

(56) References Cited

U.S. PATENT DOCUMENTS 4,603,312 A * 7/1986 Conner ..... 335/42
4,951,015 A * 8/1990 Shea et al. ..... 335/38

(Continued)

FOREIGN PATENT DOCUMENTS

FR 2445011 7/1980

*Primary Examiner* — Mohamad Musleh
(74) *Attorney, Agent, or Firm* — Novak Druce Connolly Bove + Quigg LLP

(57) ABSTRACT

The present invention relates to a magnetic protection device, in particular for an automatic circuit breaker or a disconnecting switch, preferably for use in low voltage systems. The invention also relates to an automatic circuit breaker comprising this device. The protection device (1) according to the invention comprises a low voltage circuit breaker comprising an air gap magnetic circuit (T), provided with a first portion (10) forming a first surface (11) of said air gap (T) and a second portion (20) forming a second surface (21) of the air gap (T). The first portion (10) constitutes a fixed section of the magnetic circuit, while the second portion (20) constitutes a moving section of the magnetic circuit. The magnetic circuit also comprises a flexible portion (30) that connects the first portion (10) to the second portion (20) with continuity, forming an intermediate section of magnetic circuit interposed between the fixed section and the moving section. The third flexible portion (30) advantageously allows a relative movement of the second surface (21) of the air gap (T) with respect to said first surface (11). In its essential form, the protection device (1) comprises an actuation element (50) associated with the second portion (20) of the magnetic circuit for the purpose of contacting a trip device of a circuit breaker to which the protective device is applied.

22 Claims, 13 Drawing Sheets

(56) References Cited

U.S. PATENT DOCUMENTS

| | | | | |
|---|---|---|---|---|
| 5,381,120 | A * | 1/1995 | Arnold et al. | 335/35 |
| 5,872,495 | A * | 2/1999 | DiMarco et al. | 335/35 |
| 6,157,275 | A * | 12/2000 | Gula | 335/172 |
| 6,194,982 | B1 * | 2/2001 | Mrenna et al. | 335/35 |
| 6,326,869 | B1 * | 12/2001 | Felden et al. | 335/35 |
| 6,759,931 | B1 * | 7/2004 | Lias et al. | 335/35 |
| 6,842,096 | B2 * | 1/2005 | Ciarcia et al. | 335/35 |
| 2002/0171519 | A1 * | 11/2002 | Lanning et al. | 335/172 |
| 2004/0150495 | A1 * | 8/2004 | Lias et al. | 335/2 |
| 2004/0227602 | A1 | 11/2004 | Ciarcia et al. | |
| 2009/0115556 | A1 * | 5/2009 | Faik et al. | 335/42 |
| 2009/0224861 | A1 * | 9/2009 | Tetik | 335/35 |

* cited by examiner

PROTECTION DEVICE FOR AN AUTOMATIC CIRCUIT BREAKER AND AUTOMATIC CIRCUIT BREAKER COMPRISING THIS DEVICE

CROSS REFERENCE TO RELATED APPLICATIONS

This application is a National Stage of PCT/EP2007/062070 filed Nov. 8, 2007 which in turn claims priority from Italian Application BG2006A000065 filed Dec. 21, 2006, the entire contents of which are incorporated herein by reference.

The present invention relates to a magnetic protection device, in particular for an automatic circuit breaker or a disconnecting switch, preferably for use in low voltage systems. The invention also relates to an automatic circuit breaker comprising this device.

Automatic circuit breakers, hereinafter simply called circuit breakers, are devices capable of protecting an electrical network from possible faults (such as overloads and short-circuits) by automatic opening of the circuit.

Automatic circuit breakers comprise an outer case, at least one pair of main contacts, reciprocally couplable with/decouplable from each other, an actuator device to cause said main contacts to open and close, a protection device and one or more automatic trip devices. Protection devices, hereinafter called relays, are normally of the thermal, magnetic, thermomagnetic or electronic type. The main object of relays, which are also available in varied combinations of the aforesaid types, is to cause operation of the automatic trip device of the circuit breaker when undesirable events occur.

The automatic trip device is normally part of the circuit breaker. To cause operation of the trip device, relays generate a signal, normally of the mechanical type, which is transmitted to the trip device. This signal is normally generated and transmitted by levers or solenoids which, for example, cause rotation of the trip shaft of the circuit breaker, which causes the release of the potential energy contained in specific driving devices (i.e. springs). This energy is suitably conveyed, by means of kinematic chains, to the main contacts of the circuit breaker which at the end of the trip operation must be reciprocally separated, in the open or tripped position.

In particular, magnetic relays are often used to produce instant protection. These relays are based on the principle of electromagnetic induction and make use variously of the physical phenomena linking the current circulating in a conductor to the magnetic field that is established in the surrounding area.

Magnetic relays are in practice transducers which, in predetermined conditions, convert a current (i.e. the current circulating in one of the phases of the circuit breaker) into a signal useful to trip the circuit breaker.

Magnetic relays are normally constituted by an electric induction circuit supplied by a significant current of the current to be detected (i.e. a branch winding, or simply a length of main electrode in which one of the phase currents circulates), and by a magnetic circuit which in turn comprises an armature, and a moving keeper capable of taking at least two positions, de-energized and energized respectively.

In the presence of a current of predetermined level in one of the phases of the circuit breaker (i.e. a short circuit current), the magnetic field established in the magnetic circuit of the relay generates forces on the moving keeper, capable of attracting it towards an energized position, usually in contact with the armature. Ultimately, magnetic relays make use of the movement of the keeper during switching between the de-energized and energized positions, to cause operation of the trip unit. During movement of the keeper, a lever integral therewith intercepts a cam keyed onto the trip shaft and causes it to rotate to trip the circuit breaker.

A magnetic relay of this first type, of recent conception, is described for example in U.S. Pat. No. 6,842,096 (FIG. 1). FIG. 1 shows, for example, the pivot hinge of the moving keeper and the return spring. Conceptually similar magnetic relays can also comprise additional elements, such as adjustment means, screws, return levers; or alternative elements such as sliding guides of the moving keeper.

Prior art solutions are relatively effective, but are subject to a series of drawbacks. The choice of materials used in conventional types of magnetic relays does not generally cause particularly critical states. To ensure generic operation of the relay, it is in fact sufficient to use materials that respectively have average magnetic (magnetic circuit) or elastic (return springs) characteristics, generally found in mid-range commercial products. Instead, the most critical aspect is the stability of the kinematic behaviour of moving components during the entire useful life required of the circuit breaker.

The first drawback thus consists in the lack of stability of the moving joints that allow reciprocal movement of the keeper with respect to the armature, i.e. the hinges. It is in fact known that both constructional or assembly faults and the effect of heat, the deposit of debris and wear can cause progressive phenomena of slackening of constraints, seizure of moving joints or even total block in prior art magnetic relays.

It is also evident that the general efficiency of a circuit breaker is closely linked to the efficiency of the relays. As slackening of constraints, seizure of moving joints or blocking of a relay tends to translate into premature, delayed or even non-operation of the trip unit in the event of a short circuit, these potential faults can be extremely dangerous.

Another drawback of prior art solutions consists in the high number of parts required and in the corresponding risk of erroneous assembly or imperfect reciprocal interaction.

Practice has shown that the complex configuration of prior art protection devices makes them significantly bulky with respect to the dimensions of the circuit breaker in which they are installed. This aspect considerably complicates the design and assembly of automatic circuit breakers, with an evident increase in final production costs.

On the basis of these considerations the main aim of the present invention is to provide a protection device for an automatic circuit breaker that allows the aforesaid drawbacks to be overcome.

Within this aim, an object of the present invention is to provide a protection device of magnetic type, the components of which have stable and reliable kinematic behaviour.

Another object of the present invention is to provide a protection device of magnetic type with relatively short tripping times as a result of high operating efficiency.

A further object of the present invention is to provide a protection device with an extremely compact structural configuration, or made with a limited number of parts, of simple configuration and simple to assemble.

Yet another object of the present invention is to provide a protection device that is reliable and easy to produce at competitive costs.

This aim, and said and other relative objects which will be more apparent below, are achieved by a protection device for an automatic circuit breaker as claimed in claim 1.

The protection device according to the invention has an extremely compact configuration, i.e. defined by an extremely limited number of components distinguished by stable and reliable kinematic behaviour. In particular, this advantage is achieved as a result of the physical continuity between the portions respectively defining the armature and the moving keeper of the protection device, or the magnetic circuit it forms.

Further characteristics and advantages will be more apparent from the description of a preferred but non-limiting embodiment of the protection device according to the invention, provided by way of a non-limiting example, with the aid of the accompanying figures, in which.

Figure 7:
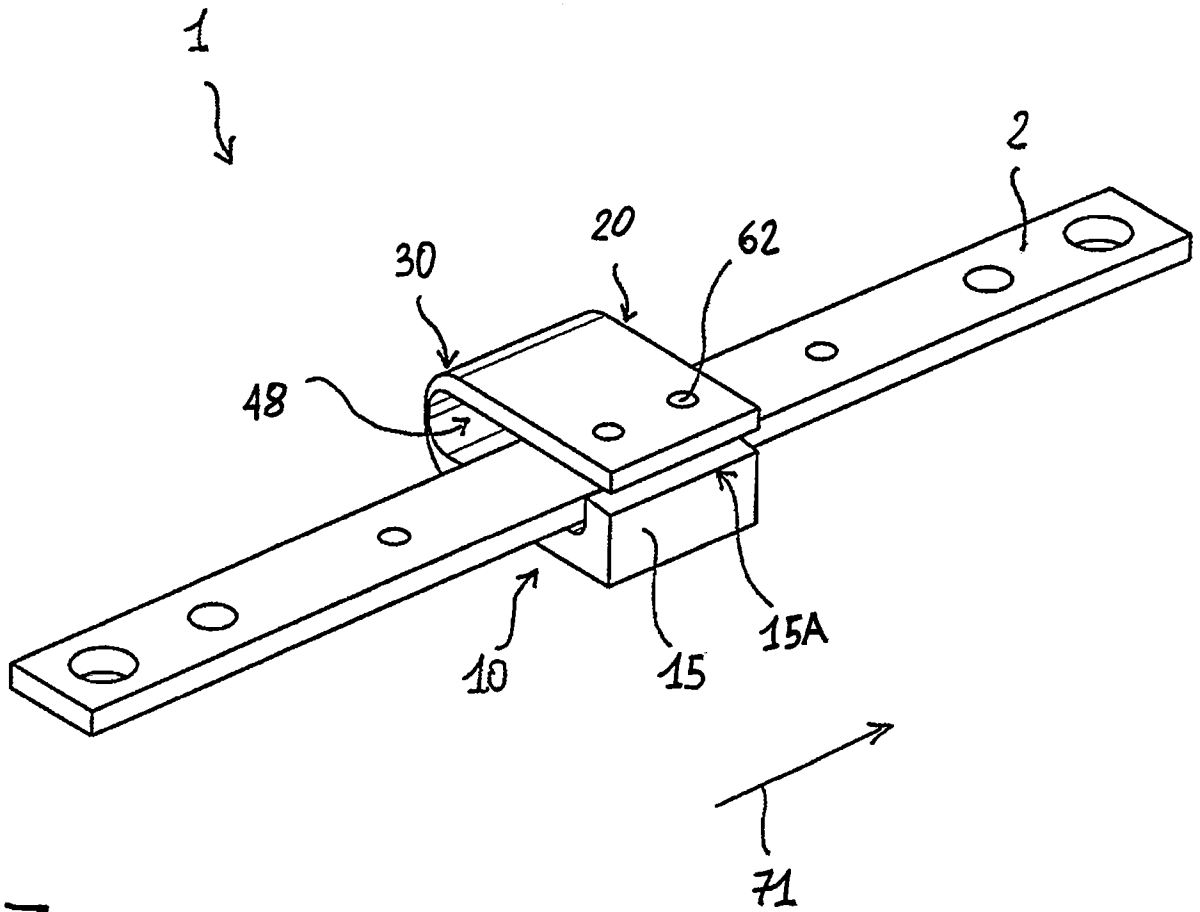
Figure 8:
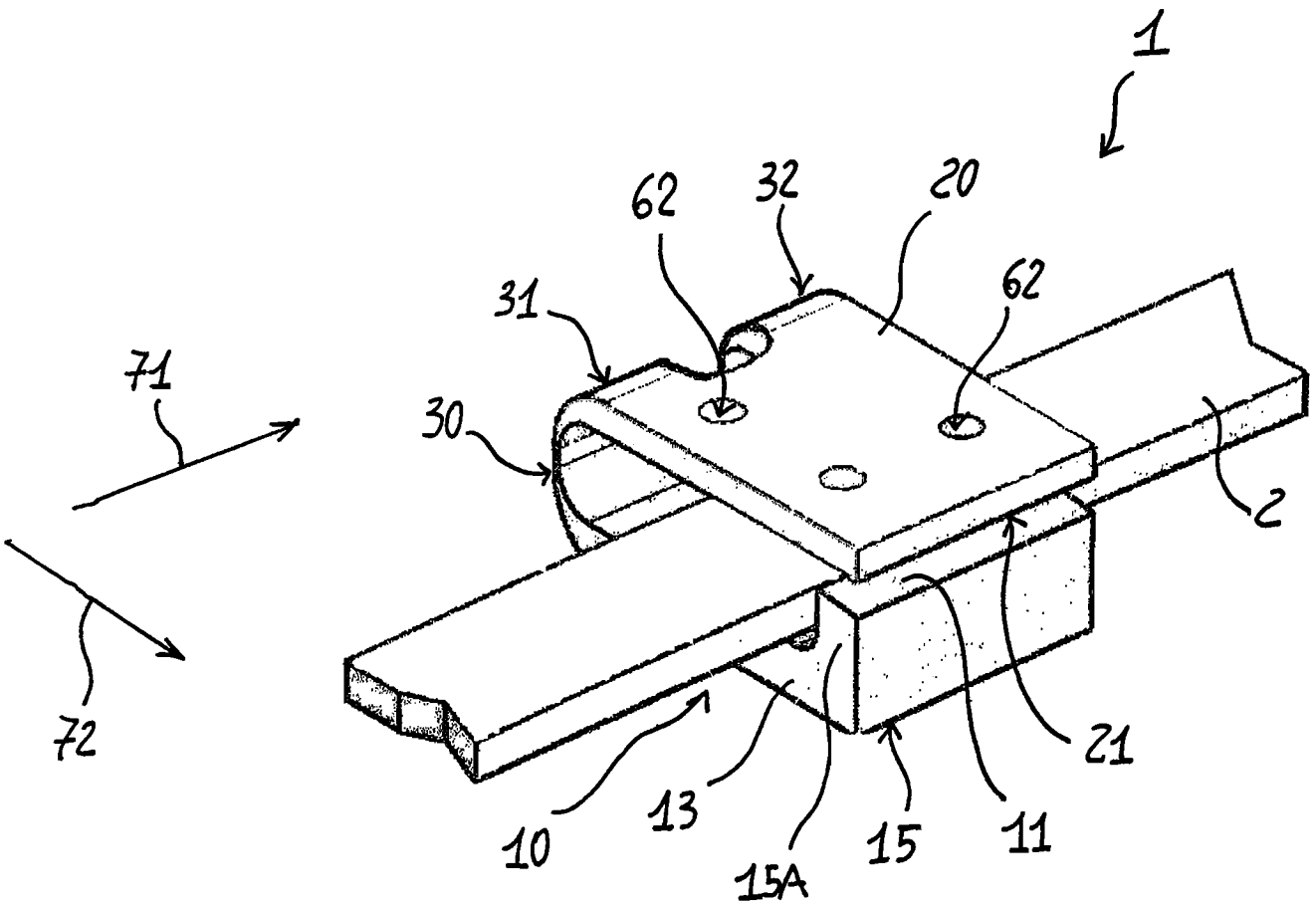
Figure 9:
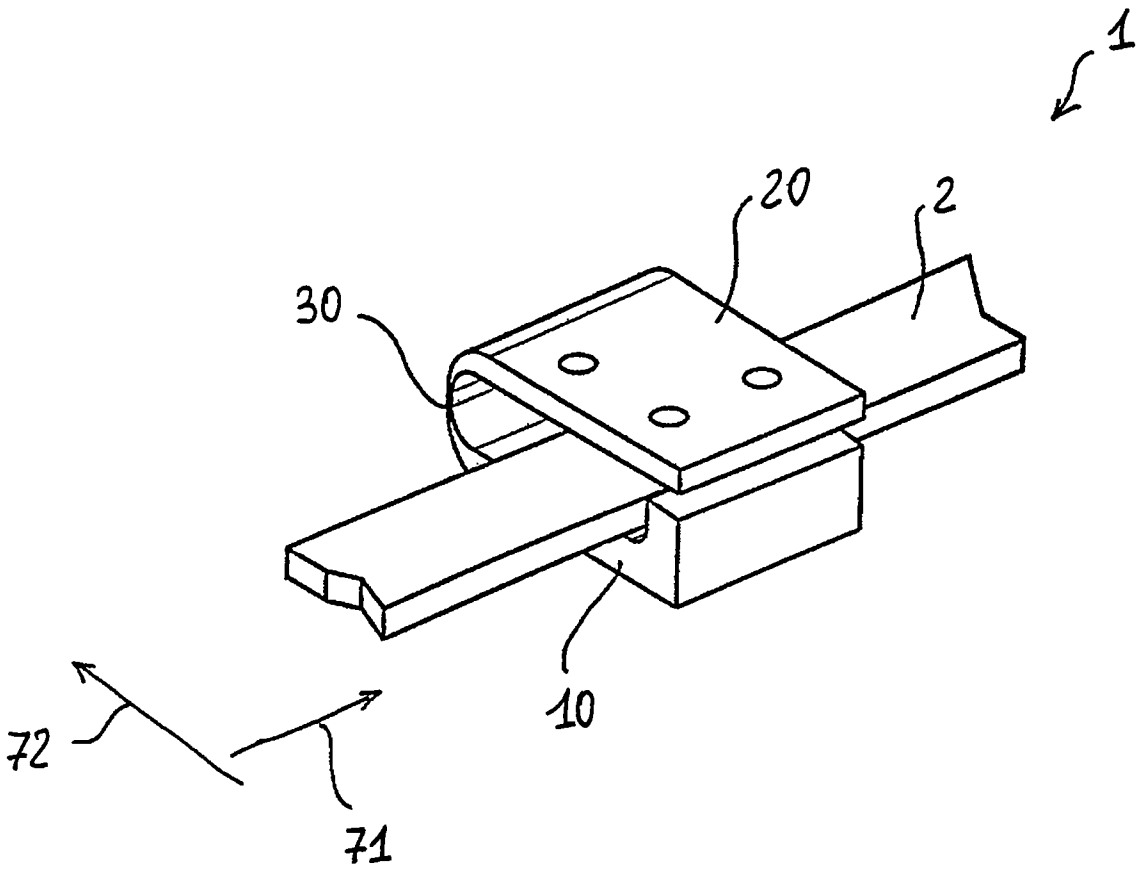
Figure 10:
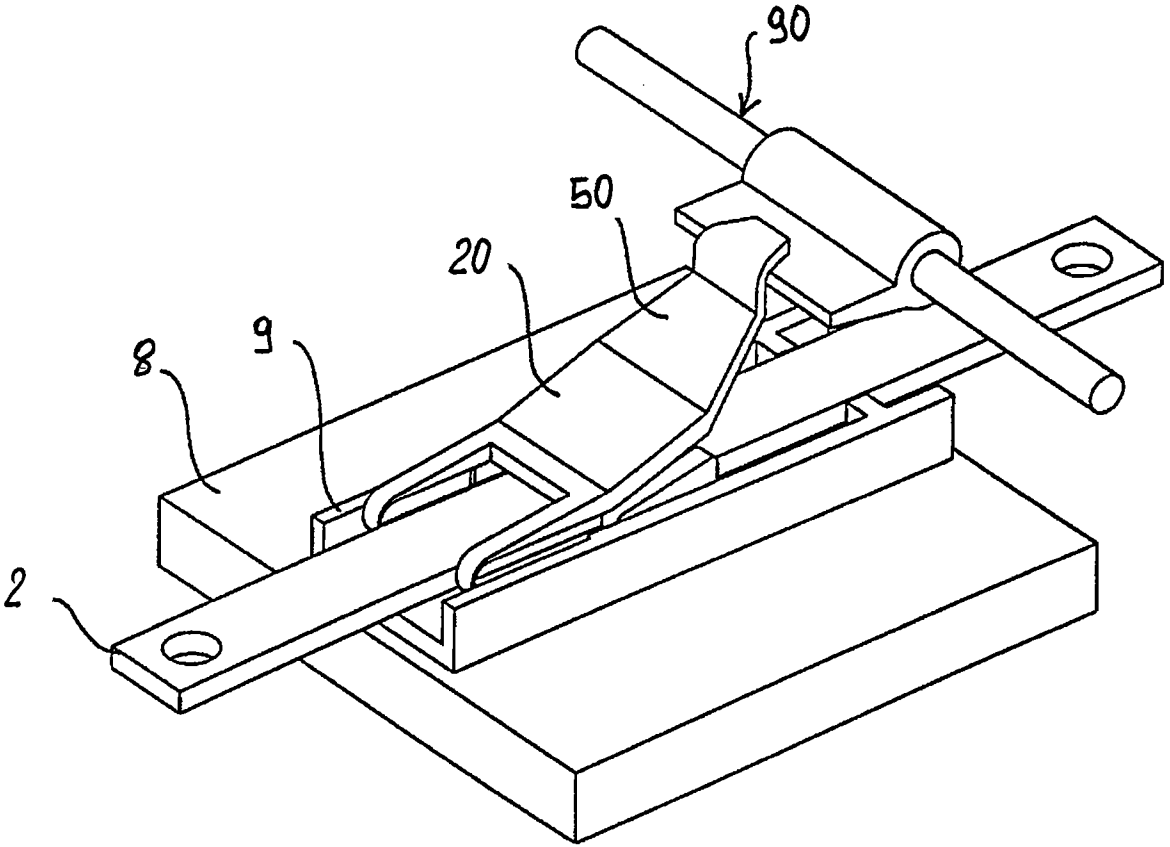
Figure 11:
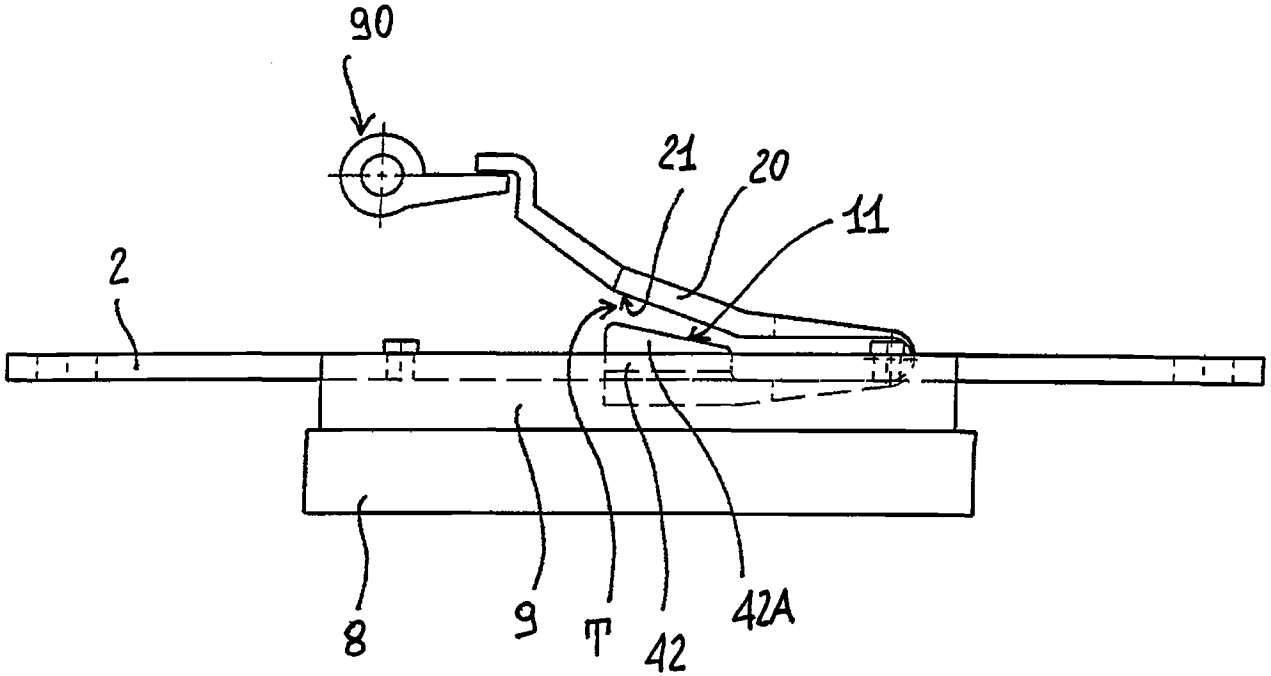
Figure 12:
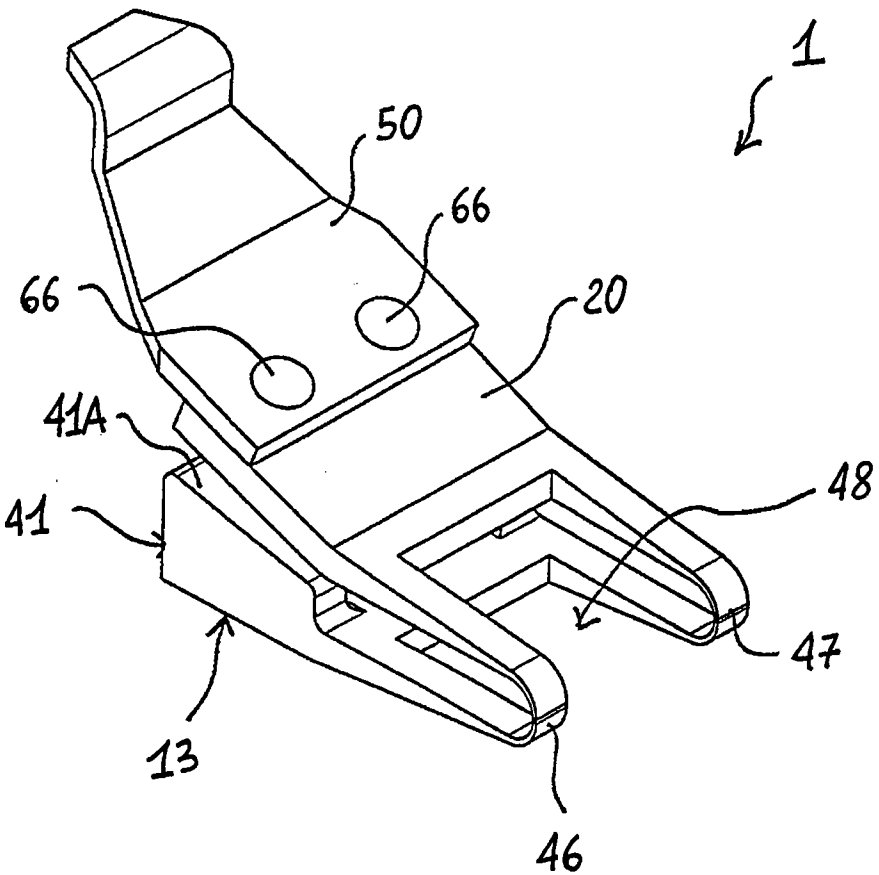
Figure 13:
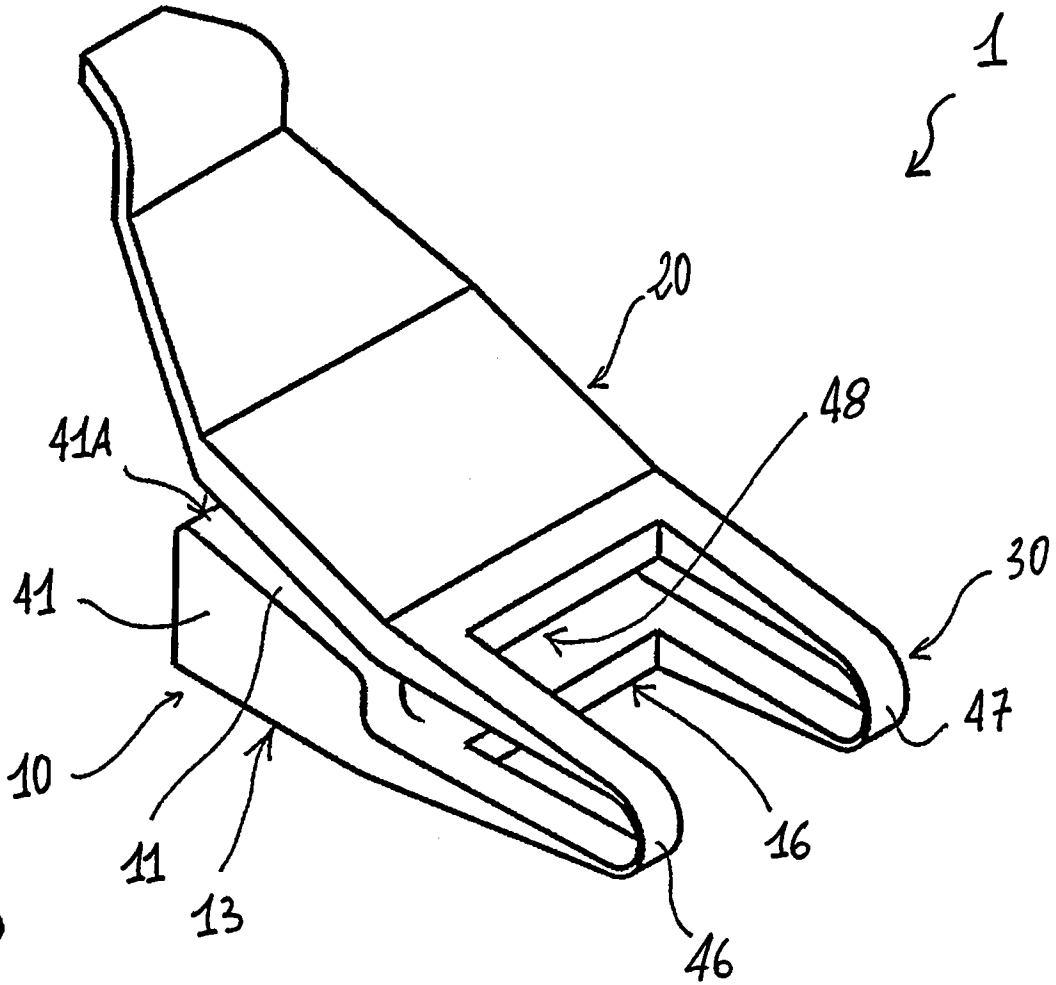

FIGS. 7, 8 and 9 relate to possible embodiments of a magnetic circuit of a protection device according to the invention;

FIG. 10 is a perspective view relative to a further embodiment of a protection device according to the invention applied to a fixed part of an automatic circuit breaker;

FIG. 11 is a side view of the protection device shown in FIG. 10;

FIG. 12 is a perspective view relative to the magnetic circuit of the protection device in FIG. 11;

FIG. 13 is a view relative to a variant of embodiment of the magnetic circuit shown in FIG. 12.

With reference to the aforesaid figures, the protection device 1 according to the invention comprises an armature and a moving keeper made of ferromagnetic material, which form an air gap magnetic circuit T, operatively intended to surround a section of one or more conductors 2 in each of which a phase current circulates. The expression conductor indicates any section of an electric circuit supplied by a significant current to be detected, such as a phase current. In particular, this conductor could be a branch winding or a section of main electrode of a circuit breaker.

The armature comprises a first portion 10 connectable to a fixed part 8 of a circuit breaker to which the protection device 1 is applied. This fixed part 8 can, for example, be constituted by a wall of the case containing the circuit breaker or by any other fixed part provided inside this case. The first portion 10 defines a fixed section of the magnetic circuit and comprises a first 11 of the two surfaces that form the air gap T. The armature also comprises a second portion 20 facing the first portion 10 defining a moving section of the magnetic circuit. The second portion 20 also comprises a second surface 21 facing the first surface 11 of the first portion 10 to completely define the air gap T.

The armature is completed by a flexible portion 30 that connects the first portion 10 to the second portion 20 with continuity, in practice forming an intermediate section of magnetic circuit interposed between the fixed section and the moving section respectively defined by the first 10 and by the second 20 portion indicated above. As can be seen in the figures, the portions 10, 20, 30 T (air gap) of the magnetic circuit in substance define an open loop 48 inside which at least one conductor 2 is operatively positioned so that the magnetic circuit defined by the portions 10, 20, 30, T (air gap) feels the effects of the current circulating in the conductor.

The protection device 1 according to the invention also comprises an actuating element 50 operatively associated with the second portion 20. It must be understood that the expression "associated" is intended both as the possibility of producing the actuation device 50 in one piece with the second portion 20 and as the possibility of connecting this element to said portion using suitable connection means 66.

The actuation element 50 is prearranged to contact, following movement of the second portion 20, a trip device 90 of the circuit breaker 2 in order to move the relative kinematic chains thereof provided to cause opening of the contacts of the circuit breaker. This trip device 90 can be constituted by a trip shaft commonly used in automatic circuit breakers or alternatively by any other functionally equivalent element that can be used for the same purposes.

Figure 1:
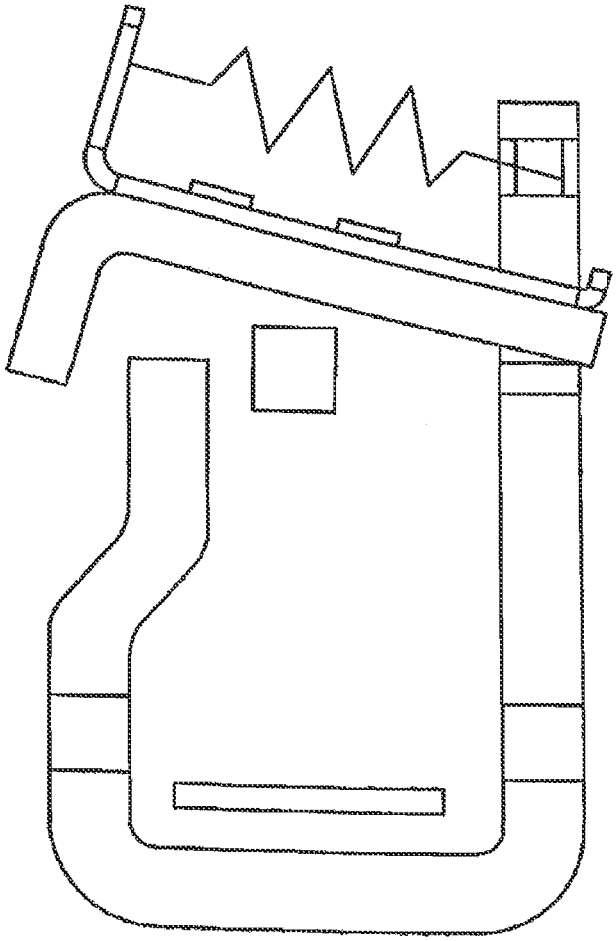
Figure 2:
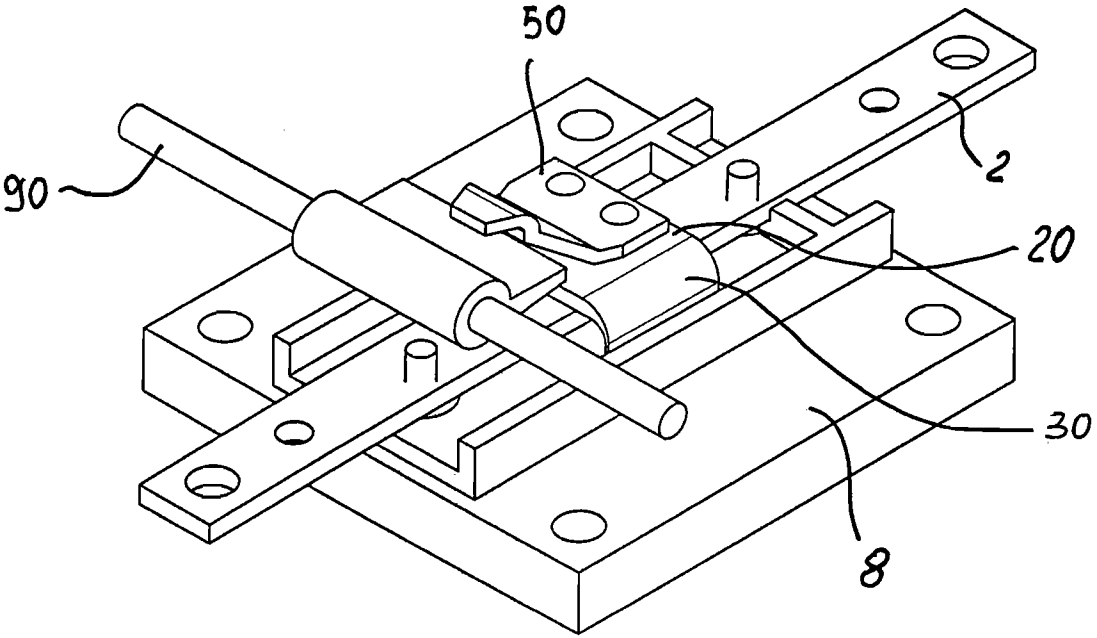
FIG. 2 is a perspective view relative to a first embodiment of a protection device according to the invention applied to a fixed part of an automatic circuit breaker.

With reference to FIG. 2, the operating principle of the protection device 1 is immediately understood. Any faulty operating conditions, such as those generated by a short circuit, cause a variation in the phase current circulating in the conductor 2. This translates into a variation in the intensity of the magnetic field that hits the magnetic circuit and consequently into the creation of a system of forces that reciprocally attracts the surfaces of the air gap T. As a result of the elasticity distinguishing the flexible portion 30, the second surface 21 of the air gap T (formed by the second portion 20) moves towards the first surface 11 defined by the first portion 10. The movement of the second portion 20 determines the movement of the actuation element 50 which in turn actuates the trip device 90 of the circuit breaker to which the protection device 1 is applied.

From the above, it is clear how the kinematic behaviour of the protection device 1 is absolutely stable and reliable for the entire useful life required of the circuit breaker. As a result of the simple configuration thereof, the flexible portion 30 in fact ensures physical continuity between the first 10 and the second 20 portion, allowing totally repeatable and reliable motion of the latter with respect to the former.

Figure 3:
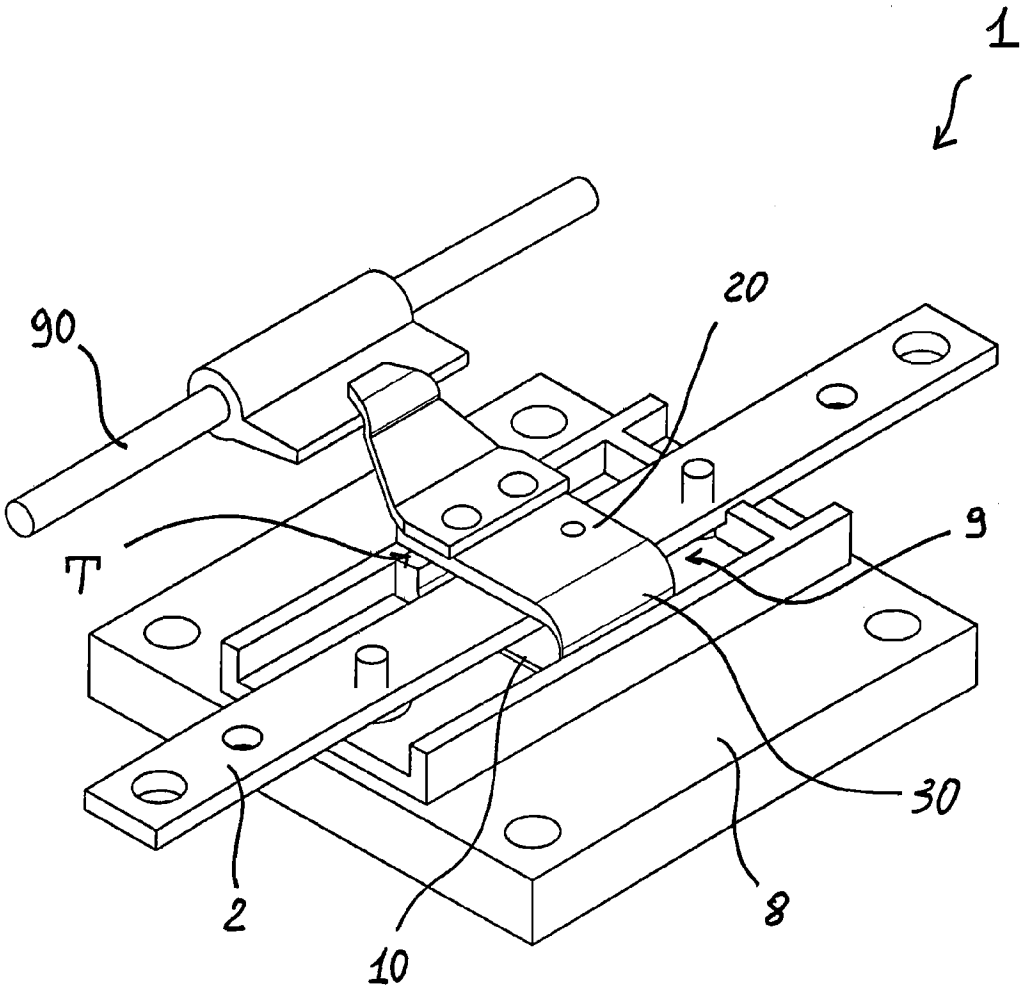
FIG. 3 is a perspective view relative to a second embodiment of a protection device according to the invention applied to a fixed part of an automatic circuit breaker.

FIGS. 2 and 3 are perspective views respectively of a first and of a second embodiment of the protection device 1 according to the present invention applied to an automatic circuit breaker. In particular, by comparing the two figures it is possible to see, with the same configuration of the armature, a different orientation of the actuation element 50, for the purpose of satisfying different constructional requirements. This highlights how the configuration of the protection device 1 and the constructional principle underlying it make the device extremely versatile, that is, capable of serving different installation requirements.

According to a preferred embodiment of the invention, the first 10, the second 20 and the flexible portion 30 are advantageously produced in one piece. This is possible as a result of the particular configuration of the portions of magnetic circuit that allows the number of components forming the protection device 1 to be reduced to a minimum. As explained in greater detail below, the actuation element 50 can also advantageously be produced in one piece with the second portion 20 so that the protection device 1 is in fact formed of a single element.

Figure 4:
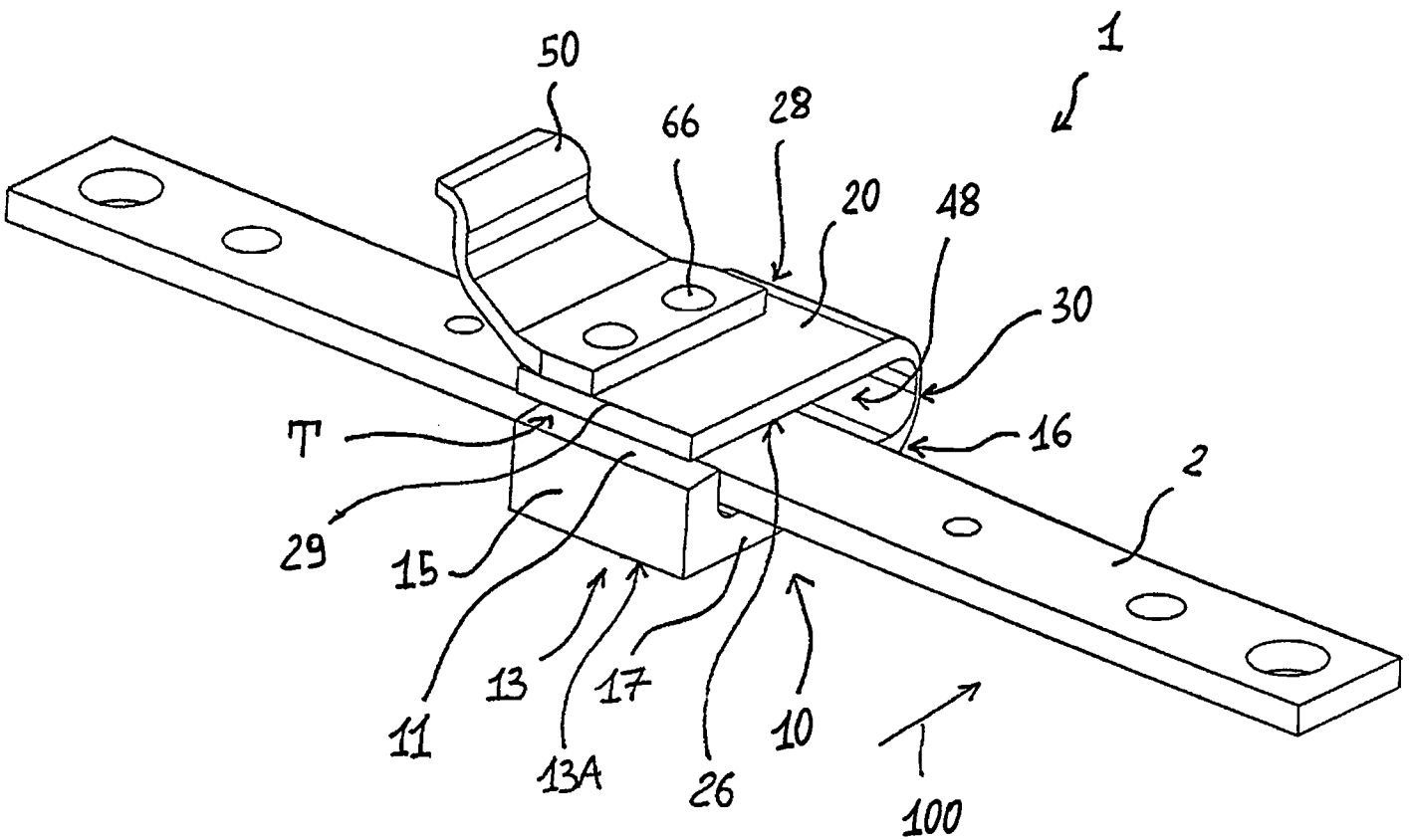
FIG. 4 is a perspective view relative to a third embodiment of a magnetic circuit of a protection device according to the invention.
Figure 5:
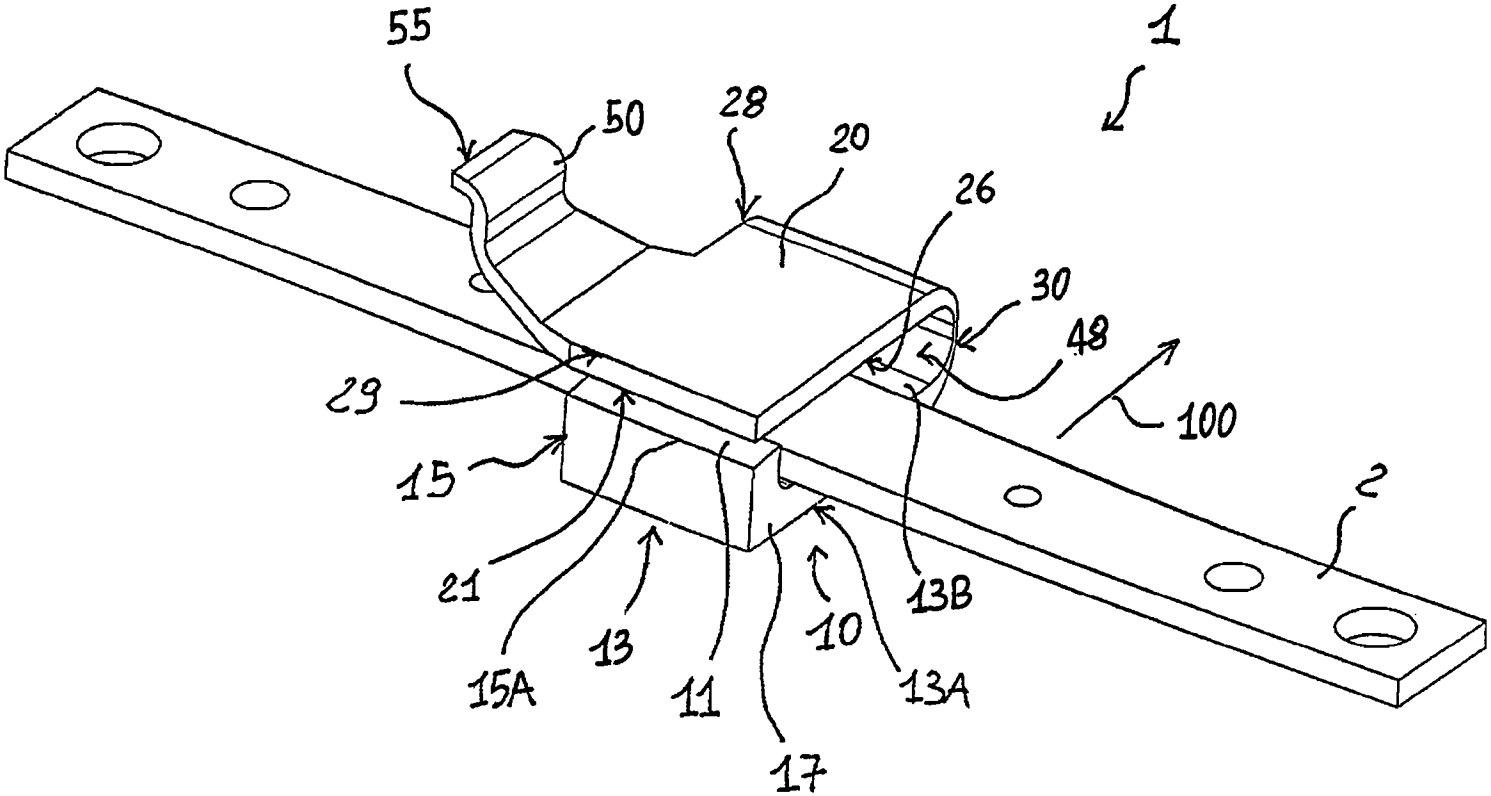
FIG. 5 is a perspective view relative to a fourth embodiment of a magnetic circuit of a protection device according to the invention.

FIGS. 4 and 5 are views respectively of a first and of a second embodiment of the protection device according to the invention. As shown, the first portion 10 comprises a flat base 13 defining a supporting surface 13A for the armature. This supporting base is advantageously connectable to a fixed part of the circuit breaker 8, for example through conventional fixing means, not shown in the figures.

The flexible portion 30 extends from a first side 16 of the flat base 13 toward a first end part 28 of the second portion 20. A lower surface 26 of the latter faces an inner surface 13B of the flat base 13 substantially opposite the supporting surface 13A. The lower surface 26 of the second portion 20 forms the aforesaid second surface 21 of the air gap T, in proximity of a second end part 29 opposite the first end part 28.

In the solution shown in the last mentioned figures, the first portion 10 comprises a shoulder 15 extending from the flat base 13 at a second side substantially opposite the first side 16 from which the flexible portion 30 extends. The shoulder 15 comprises an end part 15A forming the first surface 11 of the air gap T.

As shown, the flexible portion 30 is constituted by a flexible joint substantially bent in a U-shape connecting the first 10 and the second 20 portion so that the latter is disposed in a raised position with respect to the former. As can be seen from the viewpoint of construction, the conductor 2 is disposed operatively in the open loop 48 defined by the ferromagnetic elements and by the air gap T, that is, so as to be surrounded by the magnetic circuit.

In the solutions shown in FIGS. 3 to 9, the ferromagnetic elements 10, 20, 30 have a substantially prismatic configuration preferably extending along a main direction of reference 100. In particular, the first 10 and the second 20 portion have a prismatic configuration with a rectangular section. From a viewpoint of operative positioning, the ferromagnetic elements extend so that the conductor 2 is, for example, disposed in a position substantially orthogonal to the position of reference 100.

Figure 6:
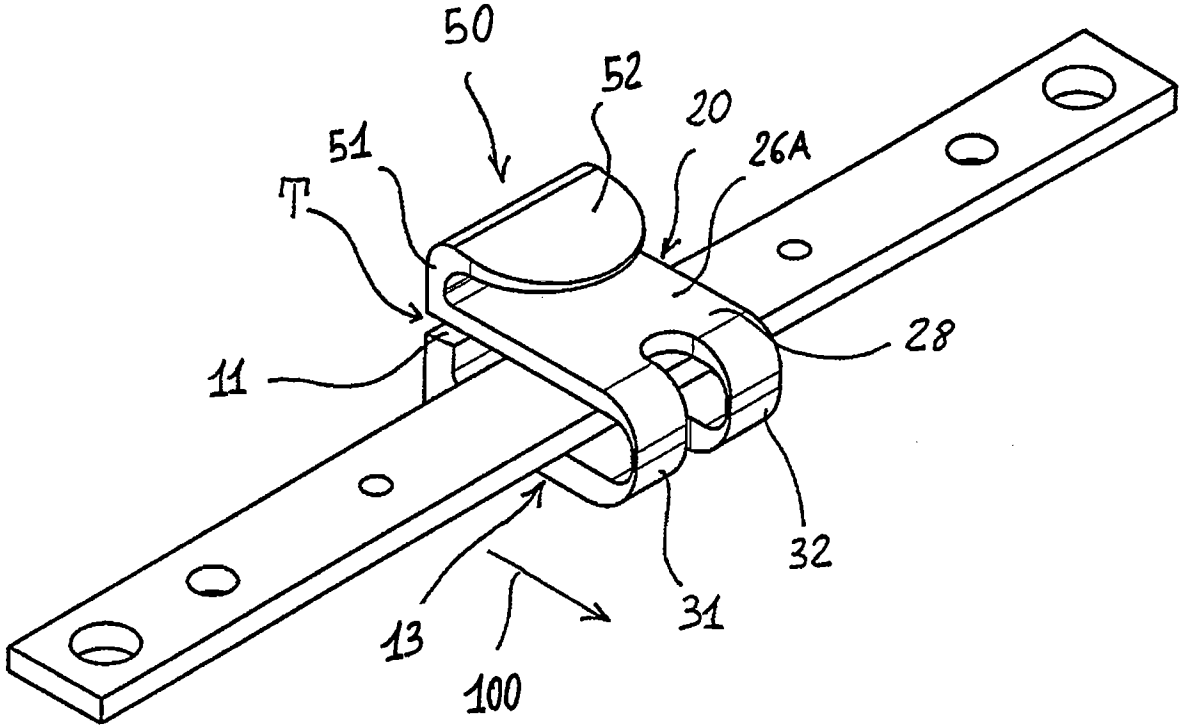
FIG. 6 is a perspective view relative to a fifth embodiment of a magnetic circuit of a protection device according to the invention.

FIG. 6 is a view relative to a third embodiment of the protection device 1 according to the invention which differs in particular from the preceding embodiments in the shape of the flexible portion 30. In fact, this portion comprises a first 31 and a second 32 flexible brace extending separately from the flat base 13 toward a first end part 28 of the second flat portion 20. The use of this pair of braces substantially bent in a U-shape allows a different distribution of the magnetic and elastic parameters to be obtained. Through the use of these braces 31, 32, suitably dimensioned, it is for example possible to obtain, with the same material, a different elasticity of the flexible portion. This allows the protection device 1 to be more or less sensitive to the electromagnetic effects induced by the phase current passing through the conductor 2, i.e. to improve configuration of various calibration requirements. The braces 31, 32 can be obtained directly during manufacture, or produced with subsequent machining operations in order to provide the overall conditions required.

With reference to FIGS. 4, 5 and 6, the actuation element 50 according to the invention can be produced in one piece with said second portion 20. Alternatively, the actuation element 50 can be produced separately from the second portion 20 and subsequently connected thereto with the use of suitable connection means 66. In particular, in the solution shown in FIG. 5, the actuation element 50 extends as an extension of one side of the second portion 20 which has a trapezoidal configuration provided with an end part 55 that is bent in order to facilitate contact with the trip device 90. In an alternative solution (see FIG. 6), the actuation element 50 extends from an upper surface 26A of the second portion 20 substantially opposite the lower surface 26 that forms the second surface 12 of the air gap T. In particular, the actuation element 50 extends according to a substantially hook-shaped configuration defined by a first connection part 51 and by a second hooking part 52 extending in a position raised with respect to the upper surface 26A.

The embodiments of the actuation element 50 described above are obviously only to be considered as two examples of embodiment which do not limit any functionally equivalent solutions that can be used for the same object and which must undoubtedly be considered as falling within the scope of the present invention.

FIGS. 7, 8 and 9 each show an embodiment of the armature 5 of the present invention distinguished by the fact that it comprises a series of openings 62 provided on the second portion 20. These openings have the function of allowing connection of the actuation element 50 to said second portion 20 cooperating with the connection means used for this object. For this purpose, the connection means 66 can include screws, rivets, pins or other functionally equivalent means.

With reference to FIG. 7, these openings 62 are disposed according to a first pre-established direction 71 to allow a corresponding first orientation of the actuation element 50 with respect to the second portion 20 or with respect to the armature 5. In the solutions shown in FIGS. 8 and 9, the openings 62 are also disposed at least according to a second pre-established direction 72. This advantageously allows the actuation element 50 to be oriented according to different constructional needs with obvious advantages, for example, from the viewpoint of design.

FIGS. 10, 11, 12 and 13 show a further possible embodiment of the protection device 1 according to the present invention, applied to a circuit breaker. More precisely, the first portion 10 (armature) comprises a first 41 and a second 42 side which extend on opposite sides of the flat base 13 so as to define a seat for connection of a portion of at least one conductor 2 of the circuit breaker. In this solution, the first surface 11 of the air gap T is constituted by a first 41A and by a second 42A end surface respectively of the first 41 and of the second 42 side. The flexible portion 30 is formed so as to allow the lower surface 26 of the second portion 20 to face the first 41A and the second 42A end surface of the two sides 41 and 42 so as to form the second surface of the air gap T.

In particular, the flexible portion 30 comprises a first 46 and a second flexible elbow 47 extending from opposite sides of a first side 16 of the flat base 13. The two flexible elbows 46 and 47 are mutually spaced apart and extend so as to define an open loop 48 which is completed by said first side 16 of the flat base 13 and by the first end part 28 of the second portion 20.

FIG. 11 is a side view of the application shown in FIG. 10 and allows the function of the open loop 48 described above to be observed. As shown, the protection device 1 is applied to the conductor 2 so that the latter is housed partially in the seat defined between the two sides 41 and 42 and in the frame 48 defined between the two flexible elbows 47, 48. From the viewpoint of installation, it can be seen that in this embodiment the conductor 2 is disposed according to the same direction 100 in which the protection device 1 extends.

Again in FIG. 11, other characteristics of this further embodiment of the protection device can also be observed. In particular, it can be seen that the two end surfaces 41A and 41B of the two sides 41, 42 of the first portion 10 extend according to a first plane substantially inclined with respect to the flat base 13 of the same portion. Likewise, the second portion 20, by means of the two flexible elbows 46 and 47, faces the end surfaces 41A and 42A of the two sides 41, 42 being disposed according to a second plane also substantially inclined with respect to the flat base 13.

FIGS. 12 and 13 show two possible variants of the embodiment of the invention described above. Similarly to the description above for the armature in FIGS. 1 to 8, the actuation element 50 can be connected to the second portion 20 through connection means 66 or alternatively produced in one piece with said portion 20.

From the viewpoint of construction, the protection device according to the invention can obviously be provided with further return and/or adjustment and/or calibration devices for the purpose of making the characteristics (elastic and magnetic) adjustable. For example, by making use of prior art solutions, it is possible to associate elastic elements (such as springs), the effect of which contributes to that of the flexible portion 30, with the second portion 20. Alternatively, retaining and/or adjustment screws could be associated with the flexible portion 30 and/or with the second portion 20. In other words, without prejudice to the reliability and various advantages deriving from the protection device 1, this can therefore advantageously be integrated with all the adjustment/calibration elements already known and already applied to prior art magnetic protection devices.

The protection device 1 according to the invention can be produced in various materials, such as silicon plate. An alternative could be constituted by the use of amorphous ferromagnetic alloys, of non-crystalline type, processed according to a fusion process with a very fast cooling rate to maintain the physical properties of the amorphous material.

The protection device according to the invention could also be produced using an injection moulding process. In particular, this could be produced from metal powders (elemental or pre-alloyed) with the addition of mouldable binders such as thermoplastics, polymer waxes. The granular feedstock thus formed can in fact be injected into a cavity to produce the desired shape, taking account of shrinkage due to removal of the binder. This removal can, for example, be performed with chemical methods (solvents or catalytic reactions), thermal methods (heating) or according to other different known systems. The subsequent technological step involves sintering to seal the particles together and obtain the finished part. Other finishing steps could follow subsequently, such as coining, heat or surface treatment, mechanical machining to reach the desired final shape. It has been seen that a material particularly suitable for this process is represented, for example, by Carbonyl Iron (Fe with ⅔% Ni).

It must be understood that the above must be considered solely as examples of technological processes and of materials that can be used to produce the protection device according to the present invention. For this reason other known processes could nonetheless be employed in alternative to those indicated.

The present invention also relates to a single-pole and multi-pole low voltage circuit breaker to be used for low voltage systems. The circuit breaker according to the invention comprises an outer case, inside which there is located at least one pair of main contacts couplable with and decouplable from each other through an actuator device. Inside the outer case, the circuit breaker comprises an automatic trip device 90 operatively connected to the actuator device to allow automatic opening of the pair or pairs of main contacts.

The automatic circuit breaker according to the invention is characterized in that it comprises a protection device 1 as defined in the present invention. In particular, the protection device 1 allows actuation of the trip device 90 and is operatively positioned at one or more conductors in which a phase current circulates. More precisely, the armature of the protection device is connected, through the flat base 13 thereof, to a fixed part of the circuit breaker which can, for example, be a wall of the containing case. This positioning of the protection device can be direct, in the sense that the armature is connected directly to the fixed part, or can be mediated by a positioning template 9 as shown in the applications indicated in FIGS. 2, 3, 9 and 10.

The technical solutions adopted for the protection device according to the invention allow the aims and objects set to be fully achieved. The protection device as conceived is constituted by a minimum number of components, easy to produce and easily assembled together. Moreover, the protection device is particularly reliable and efficient as a result of the innovative structural configuration thereof.

In practice, the materials used, the dimensions and contingent shapes can be any according to requirements and to the state of the art.

The invention claimed is:

1. Protection device for a low voltage automatic circuit breaker characterized in that it comprises a magnetic circuit with air gap (T), said circuit comprising:

a first portion forming a first surface of said air gap (T), said first portion defining a fixed section of said magnetic circuit;

a second portion forming a second surface of said air gap (T) which faces said first surface of said first portion, said second portion constituting a moving section of said magnetic circuit;

an elastic flexible portion that connects said first portion to said second portion with continuity, forming an intermediate section of magnetic circuit interposed between said fixed section and said moving section, said flexible portion allowing a relative movement of said second surface with respect to said first surface;

said protection device also comprising an actuation element associated with said second portion of said magnetic circuit; wherein the first portion, the second portion and the elastic flexible portion collectively form a single component.

2. Protection device as claimed in claim 1, characterized in that said first, said second and said flexible portion are produced in one piece.

3. Protection device as claimed in claim 1, characterized in that said first portion comprises a flat base defining a first supporting surface for said magnetic circuit, said flexible portion extending from a first side of said flat base towards a first end part of said second portion, a lower surface of said second portion facing said flat base of said first portion, said lower surface forming said second surface of said air gap (T) in proximity of a second end part of said second portion opposite said first end part.

4. Protection device as claimed in claim 3, characterized in that said first potion comprises a shoulder extending from said flat base at a second side substantially opposite said first side, said shoulder comprising an end part forming said first surface of said air gap (T).

5. Protection device as claimed in claim 4, characterized in that said flexible portion is constituted by a joint substantially bent in a U-shape connecting said first terminal part of said second portion to said first side of said flat base.

6. Protection device as claimed in claim 4, characterized in that said flexible portion comprises a first and a second flexible brace, each of said flexible braces extending separately from said first side of said base to said first end part of said second portion.

7. Protection device as claimed in claim 1, characterized in that said first portion comprises a first and a second side which extend from said flat base on opposite sides, said first surface of said air gap (T) being constituted by a first and by a second end surface respectively of said first and of said second side, said flexible portion being formed so as to allow said lower surface of said second portion to face said first and said second end surface to form said second surface of said air gap (T), said first and said second end surface of said sides extending according to a plane inclined with respect to said flat base of said first portion.

8. Protection device as claimed in claim 7, characterized in that said flexible portion comprises a first and a second flexible elbow extending on opposite sides of said first side of said flat base.

9. Protection device as claimed in claim 1, characterized in that said actuation element is produced in one piece with said second portion of said actuation element made of ferromagnetic material.

10. Protection device as claimed in claim 9, characterized in that said actuation element extends on one side of said second portion, said actuation element having a trapezoidal configuration comprising a bent end part.

11. Protection device as claimed in claim 9, characterized in that said actuation element extends from an upper surface of said second portion substantially opposite said lower surface, said actuation element having a substantially hook shaped configuration defined by a first connection part and by a second hooking part extending in a position raised with respect to said upper surface.

12. Protection device as claimed in claim 1, characterized in that said actuation element is fixed to said second portion through connection means.

13. Protection device as claimed in claim 12, characterized in that said second portion comprises a series of openings suitable to cooperate with said first connection means to connect said actuation element to said second portion, said openings being produced according to a first pre-established direction to allow a corresponding first orientation of said actuation element with respect to said second portion.

14. Protection device as claimed in claim 13, characterized in that said openings are produced according to at least one pre-established direction to allow a corresponding second orientation of said actuation element with respect to said portion.

15. Single-pole or multi-pole low voltage circuit breaker for low voltage systems, comprising:

an outer case;

at least one pair of main contacts couplable with/decouplable from each other;

an actuator device for opening and closing each of said pairs of main contacts;

an automatic trip device operatively connected to said actuator device for automatic opening of said at least one pair of main contacts a protection device for actuation of said trip device, characterized in that said protection device is defined as claimed in claim 1, said actuation element of said protection device being connected to a fixed part of said circuit breaker to surround one or more conductors through which a phase current passes, said elastic flexible portion of said actuation element allowing movement of said second portion with respect to said first portion following a variation in the intensity of said phase current, said actuation element of said protection device contacting said trip device following movement of said second portion of said actuation element.

16. Protection device as claimed in claim 2, characterized in that said first portion comprises a flat base defining a first supporting surface for said magnetic circuit, said flexible portion extending from a first side of said flat base towards a first end part of said second portion, a lower surface of said second portion facing said flat base of said first portion, said lower surface forming said second surface of said air gap (T) in proximity of a second end part of said second portion opposite said first end part.

17. Protection device as claimed in claim 2, characterized in that said first portion comprises a first and a second side which extend from said flat base on opposite sides, said first surface of said air gap (T) being constituted by a first and by a second end surface respectively of said first and of said second side, said flexible portion being formed so as to allow said lower surface of said second portion to face said first and said second end surface to form said second surface of said air gap (T), said first and said second end surface of said sides extending according to a plane inclined with respect to said flat base of said first portion.

18. Protection device as claimed in claim 3, characterized in that said first portion comprises a first and a second side which extend from said flat base on opposite sides, said first surface of said air gap (T) being constituted by a first and by a second end surface respectively of said first and of said second side, said flexible portion being formed so as to allow said lower surface of said second portion to face said first and said second end surface to form said second surface of said air gap (T), said first and said second end surface of said sides extending according to a plane inclined with respect to said flat base of said first portion.

19. Protection device as claimed in claim 2, characterized in that said actuation element is produced in one piece with said second portion of said actuation element made of ferromagnetic material.

20. Protection device as claimed in claim 3, characterized in that said actuation element is produced in one piece with said second portion of said actuation element made of ferromagnetic material.

21. The protection device of claim 1, wherein said flexible portion is made of flexible material.

22. Protection device as claimed in claim 1, characterized in that said flexible portion is constituted by an elastic joint substantially bent in a U-shape.

* * * * *